US008269625B2

(12) United States Patent
Hoy et al.

(10) Patent No.: US 8,269,625 B2
(45) Date of Patent: Sep. 18, 2012

(54) SIGNAL PROCESSING SYSTEM AND METHODS FOR RELIABLY DETECTING AUDIBLE ALARMS

(75) Inventors: Leslies D. Hoy, Knoxville, TN (US); David E. Albert, Oklahoma City, OK (US); Landgrave T. Smith, Oklahoma City, OK (US); James J. Lewis, Oklahoma City, OK (US)

(73) Assignee: InnovAlarm Corporation, Oklahoma City, OK (US)

( * ) Notice: Subject to any disclaimer, the term of this patent is extended or adjusted under 35 U.S.C. 154(b) by 408 days.

(21) Appl. No.: 12/756,698

(22) Filed: Apr. 8, 2010

(65) Prior Publication Data

US 2011/0025499 A1 Feb. 3, 2011

Related U.S. Application Data

(60) Provisional application No. 61/229,684, filed on Jul. 29, 2009.

(51) Int. Cl.
*G08B 21/00* (2006.01)

(52) U.S. Cl. ..... 340/540; 340/628; 340/539.1

(58) Field of Classification Search ..... 340/540, 340/628, 506, 507, 531, 532, 533, 539.1, 340/902, 458, 438, 942, 944
See application file for complete search history.

(56) References Cited

U.S. PATENT DOCUMENTS 4,091,366 A 5/1978 Lavallee
4,180,810 A 12/1979 Muncheryan
4,186,389 A 1/1980 Flittie
4,237,449 A 12/1980 Zibell
4,365,238 A * 12/1982 Kollin ..... 340/521
4,417,235 A 11/1983 Del Grande
4,450,436 A 5/1984 Massa
4,461,927 A 7/1984 Olson et al.
4,617,555 A 10/1986 Sheiman (Continued)

FOREIGN PATENT DOCUMENTS

JP 2003 210515 A 7/2003

OTHER PUBLICATIONS

International Search Report and Written Opinion mailed Oct. 11, 2010 for related International Application No. PCT/US2010/043771.

(Continued)

*Primary Examiner* — Daniel Previl
(74) *Attorney, Agent, or Firm* — Knobbe, Martens, Olson & Bear LLP

(57) ABSTRACT

A signal processing system and associated methods are disclosed for reliably detecting audible alert signals, such as Temporal-3 (or Code-3) and Temporal-4 (or Code-4) alert signals generated by commercially available smoke, fire, and carbon monoxide detectors. The system and methods are capable of detecting audible alert signals of different intensities in the presence of dynamic background environment (e.g., television programming, music, noise, and the like). The system and methods are capable of detecting audible alert signals generated by far away smoke, fire, and carbon monoxide detectors. The signal processing system and methods may, in some embodiments, be incorporated into a bedside or other unit that generates a supplemental alert signal capable of alerting individuals who might not otherwise respond to the alarm condition, such as individuals who are asleep, children, hearing impaired, or intoxicated.

20 Claims, 10 Drawing Sheets

U.S. PATENT DOCUMENTS

| | | | | |
|---|---|---|---|---|
| 4,897,862 | A | 1/1990 | Nishihara et al. | |
| 4,935,952 | A | 6/1990 | Dutra | |
| 4,956,866 | A | 9/1990 | Bernstein et al. | |
| 4,996,517 | A * | 2/1991 | Kringen et al. | 340/506 |
| 5,012,223 | A | 4/1991 | Griebell et al. | |
| 5,177,461 | A | 1/1993 | Budzyna et al. | |
| 5,287,411 | A | 2/1994 | Hill et al. | |
| 5,651,070 | A | 7/1997 | Blunt | |
| 5,666,331 | A | 9/1997 | Kollin | |
| 5,797,852 | A | 8/1998 | Karakasoglue et al. | |
| 5,867,105 | A | 2/1999 | Hajel | |
| 5,889,468 | A | 3/1999 | Banga | |
| 5,898,369 | A | 4/1999 | Godwin | |
| 5,999,089 | A | 12/1999 | Carlson | |
| 6,087,960 | A | 7/2000 | Kyouno et al. | |
| 6,215,404 | B1 | 4/2001 | Morales | |
| 6,384,724 | B1 | 5/2002 | Landais | |
| 6,420,973 | B2 | 7/2002 | Acevedo | |
| 6,553,100 | B1 | 4/2003 | Chen et al. | |
| 6,658,123 | B1 | 12/2003 | Crutcher | |
| 7,501,958 | B2 | 3/2009 | Saltzstein et al. | |
| 2004/0145467 | A1 | 7/2004 | Roby et al. | |
| 2006/0250260 | A1 * | 11/2006 | Albert et al. | 340/628 |

OTHER PUBLICATIONS

Griebell, C.A. 1991 "Detecting the audible alarm of residual smoke detectors and its applications" *Consumer Electronics, IEEE Transactions on Consumer Electronics* 37(3):401-405. Abstract.

Ellis, Dan "Detecting Alarm Sounds" Department of Electrical Engineering, Columbia University. CRAC Poster. 2001.

Web page labeled "Alarm Sound Detection" by Ellis, D.P.W., printed from Columbia University website, http://www.ee.columibia.edu/~dpwe/projects/alarmdetect.html, on Nov. 1, 2010 (2 printed pages).

Ellis, D.P.W., "The Listening Machine: 1st Annual Report," dated Mar. 15, 2004.

Moncrieff, S. et al., "Incorporating Contextual Audio for an Actively Anxious Smart Home" *Intelligent Sensors, Sensor Networks and Information Processing Conference, 2005, Proceedings of the 2005 International Conference* 5(8):373-78.

Obata, K. et al., "A New Sound Source Location Algorithm Based on Formant Frequency for Sound Image Localization" *Multimedia and Expo, 2003. ICME '03. Proceedings. 2003 International Conference* 6-9(1):729-32, 2003.

Web page labeled "Audio Detector for Starting Robots" by Barello, L., printed from Seattle Robotics website, http://www.seattlerobotics.org/encoder/200005/audio_detector_circuit.html, on Oct. 25, 2007 (4 printed pages).

Web page labeled "Sound Detector Latch," printed from http://www.reconnsworld.com/audio_sounddetectlatch.html on Oct. 25, 2007 (1 printed page).

Web page labeled "Simple Sound Detection Circuit." Revolution Education Ltd 2003.

Web page labeled "Audio Detector Circuit" by Barello, L., printed from Seattle Robotics website, http://www.seattlerobotics.org/encoder/200003/larryb.html, on Oct. 25, 2007 (2 printed pages).

Web page labeled "Computer Security System," printed from http://www.sarbash.com/pro_csss.shtml on Sep. 7, 2002 (4 printed pages).

Web page labeled "CSSS—Computer Sound Security System," printed from PRWeb website, http://www.prweb.com/releases/2001/prweb25104.htm, on Nov. 14, 2003 (2 printed pages).

Web page describing BEBE Sound Baby Movement Sensor and Sound product, printed from ShoppersChoice website, http://www.shopperschoice.com/item_item_1536072_source_froogle.html, on Jun. 20, 2007 (1 printed page).

Web page describing RoboNanny v1.00—Home security monitoring tool, printed from Spy Arsenal website, http://www.spyarsenal.com/spy-microphone/, on Nov. 14, 2003 (3 printed pages).

International Preliminary Report on Patentability mailed Feb. 9, 2012 in International Application No. PCT/US2010/043771 in 7 pages.

* cited by examiner

SIGNAL PROCESSING SYSTEM AND METHODS FOR RELIABLY DETECTING AUDIBLE ALARMS

CROSS-REFERENCE TO RELATED APPLICATIONS

This application is related to, and claims the benefit of, U.S. Provisional Patent Application No. 61/229,684, filed Jul. 29, 2009, the disclosure of which is hereby incorporated by reference herein.

BACKGROUND

1. Technical Field

The present invention relates to signal processing circuits and methods for reliably detecting audible alarm signals generated by smoke detectors, carbon monoxide detectors, and/or other types of detectors.

2. Description of the Related Art

The presence of smoke, fire, hazardous carbon monoxide concentrations are commonly sensed in commercially available products using several types of technologies. These products traditionally alert the occupants using loud audible alarms of loud tones. Regulations exist that require audible alarms to produce signals that alert individuals in case of a fire and other emergencies. Examples of such regulations are: Underwriters Laboratories code 217 (UL 217, "The Standard of Safety for Single and Multiple Station Smoke Alarms"), Underwriters Laboratories code 464 (UL 464, "The Standard of Safety for Audible Signal Appliances"), Underwriters Laboratories code 1971 (UL 1971, "The Standard for Signaling Devices for the Hearing Impaired"), and Underwriters Laboratories code 2034 (UL 2034, "The Standard of Safety for Single and Multiple Station Carbon Monoxide Alarms").

According to these and other standards, typical smoke, fire, and carbon monoxide detectors produce a 3100-3200 Hz pure tone alert signal with the intensity (or power) of 45 to 120 dB (A-weighted for human hearing). However, using the pure tone signal can result in a less than effective means of alerting people with hearing loss, older adults, children, heavy sleepers, and intoxicated persons. Traditional means of alerting can be inadequate especially at night time when the audible alarm is not located near the individual. If individuals are not alerted, the results can range from inconvenient to deadly.

Current state of the art attempts to address these deficiencies by interconnecting alarms using wires or wirelessly. Alarms thusly networked together can communicate detection conditions and "trigger" each other. One example of such technology is Kidde Wireless Smoke Alarm Model RF-SM-DC or RF-SM-AC Smoke Alarm. However, such solutions can be expensive and unreliable for alerting people with hearing loss, older adults, children, heavy sleepers, and intoxicated persons.

Another solution for these deficiencies is the introduction of a detection device that "listens" for audible signals generated by smoke, fire, and carbon monoxide detectors. Upon detecting an audible alert signal, the detection device can trigger supplemental alert devices that are configured to reliably alert the individual to the presence of fire, smoke, carbon monoxide, and the like. One type of supplemental alerting is to generate a loud low frequency (e.g., 520 Hz) square wave sound pattern that can reliably alert people with hearing loss, older adults, children, heavy sleepers, and intoxicated persons as is described in U.S. Pat. No. 6,658,123 to Crutcher, the disclosure of which is hereby incorporated by reference.

One difficulty with designing such detection devices is to reliably detect audible alert signals generated by smoke, fire, and carbon monoxide detectors. Ideally, reliable detection cannot tolerate any false negative conditions (i.e., non-detection of actual audible alert signals) and can tolerate only a few false positive conditions (i.e., false detection of audible alert signals when, in fact, none actually occurred). These can be restated as requirements of high sensitivity and high specificity, respectively. False negative conditions cannot be tolerated because if individuals are not alerted, the results can range from inconvenient to deadly. False positive conditions ought to occur infrequently because they can cause individuals to disconnect smoke, fire, and carbon monoxide detectors and/or the detection devices.

Even though existing regulations (such as UL 217, UL 464, UL 1971, UL 2034, NFPA 72, ANSI 53.41, and ISO-8201) govern the characteristics of audible alert signals generated by commercially available smoke, fire, and carbon monoxide detectors, there still exist many problems with the reliable detection of these signals. Testing performed by LifeTone Technology™ demonstrates that commercially available detectors often produce audible alert signals that "drift" from the specifications of the existing regulations. In fact, approximately 11% of commercially available detectors do not meet the specifications of some or all of the above mentioned UL regulations. In addition, sources of audible alert signals can be located far away causing audible alert signals to have weak intensity by the time the detection device is reached. Moreover, other signals such as music, television programming, and noise can distort, weaken, or drown out audible alert signals before the detection device is reached. These problems can be further compounded when background signals have components, which potentially have higher signal intensity than the audible alert signals, and when such components also overlap in frequency and periodicity with the audible alert signals. Accordingly, there is a need for a detection device that can provide reliable detection (i.e., high sensitivity) while producing few false negative conditions (i.e., high specificity).

SUMMARY OF THE DISCLOSURE

Various embodiments of a system and machine-implemented process are disclosed for reliably detecting audible alert signals, such as beeps, Temporal-3 (or Code-3) smoke alert signals, and Temporal-4 (or Code-4) carbon monoxide alert signals. Some embodiments of the system and process can reliably detect audible alert signals generated by commercially available smoke, fire, and carbon monoxide detectors, including audible alert signals of different intensities. The disclosed system and process can also reliably detect audible alert signals in the presence of background noise of varying intensity. Upon detecting an audible alert signal, the system and process may, in some embodiments, generate (or initiate the generation of) a supplemental alert signal capable of alerting individuals who might not otherwise respond to the alarm condition, such as children, persons who are asleep, hearing impaired persons, or intoxicated persons.

A method for detecting audible alert signals implemented in signal processing circuitry is disclosed. The method can comprise generating a digital representation of a received audio signal and, for each of a plurality of templates, comparing the digital representation of the received audio signal to the respective template, and generating a matching score representing a degree of match between the digital representation of the received audio signal and the respective template. Each template corresponds to an acceptable audible alert signal timing pattern, and the plurality of templates encompass an acceptable range of variation in a timing pattern of a standard audible alert signal. The method also can comprise determining, based at least partly on the matching scores corresponding to the plurality of templates, whether an audible alert signal is present. The plurality of templates can comprise templates that correspond to variations, for example, in the Temporal-3 or Temporal-4 timing patterns.

A computer-readable medium which stores executable instructions capable of causing a computing device to perform a signal processing method is disclosed. The method can comprise generating a digital representation of a received audio signal and, for each of a plurality of templates, comparing the digital representation of the received audio signal to the respective template, and generating a matching score representing a degree of match between the digital representation of the received audio signal and the respective template. Each template corresponds to an acceptable audible alert signal timing pattern, and the plurality of templates encompass an acceptable range of variation in a timing pattern of a standard audible alert signal. The method can also comprise determining, based at least partly on the matching scores corresponding to the plurality of templates, whether an audible alert signal is present. The plurality of templates can comprise templates that correspond to variations, for example, in the Temporal-3 or Temporal-4 timing patterns. In addition, the method can comprise estimating a noise content of the received audio signal and determining, based at least partly on the noise content, whether an audible alert signal is present.

A signal processing system for detecting audible alert signals is disclosed. The system can comprise a circuit configured to receive an audio signal and to generate a digital representation of the received audio signal. The system can also comprise a memory buffer configured to store a plurality of templates, wherein each template corresponds to an acceptable audible alert signal timing pattern, and the plurality of templates encompass an acceptable range of variation in a timing pattern of a standard audible alert signal. The system can also comprise a circuit configured to compare the digital representation of the received audio signal to the respective template, to generate a matching score representing a degree of match between the digital representation of the received audio signal and the respective template, and to determine, based at least partly on the matching scores corresponding to the plurality of templates, whether an audible alert signal is present. The plurality of templates can comprise templates that correspond to variations, for example, in the Temporal-3 or Temporal-4 timing patterns. In addition, the system can comprise a supplemental alert generator configured to generate a supplemental alert signal in response to the determination that an audible alert signal is present.

The system and methods can be implemented in a bedside unit, a portable device, a general purpose computer, or the like.

Neither this summary nor the following detailed description purports to define the invention. The invention is defined only by the claims.

BRIEF DESCRIPTION OF THE DRAWINGS

These and other features will now be described with reference to the drawing summarized below. These drawings and the associated description are provided to illustrate specific embodiments of the invention, and not to limit the scope of the invention.

DETAILED DESCRIPTION OF THE PREFERRED EMBODIMENTS

The present invention comprises signal processing methods and associated circuitry for reliably detecting audible alert/alarm signals such as those generated by commercially available smoke, fire, and carbon monoxide detectors. For purposes of illustrating a preferred embodiment of the invention, the circuitry and signal processing methods are described in the context of a system that, upon detecting an audible alert signal, generates a supplemental alert signal capable of alerting individuals who might not otherwise respond to the alarm condition, such as children, persons who are asleep, hearing impaired persons, or intoxicated persons. As will be apparent, the disclosed signal processing circuitry and methods can also be used for other applications, such as the monitoring of alarm conditions by police, fire, emergency and security personnel.

In some embodiments, the system can be adapted to be positioned at the bedside (and can also serve as an alarm clock) or to be mounted to a fixed structure, such as a wall or ceiling, as is described in U.S. Pat. No. 7,501,958 to Saltzstein et al., the disclosure of which is hereby incorporated by reference. In some embodiments and as is described in Saltzstein et al., the system can be a wearable, battery-operated device. For instance, the device can be configured to be worn on an individual's wrist (and can also serve as a wrist watch), can be incorporated into a hearing aid that is configured for insertion into the patient's ear, or can be incorporated into a general purpose computer.

Figure 1:
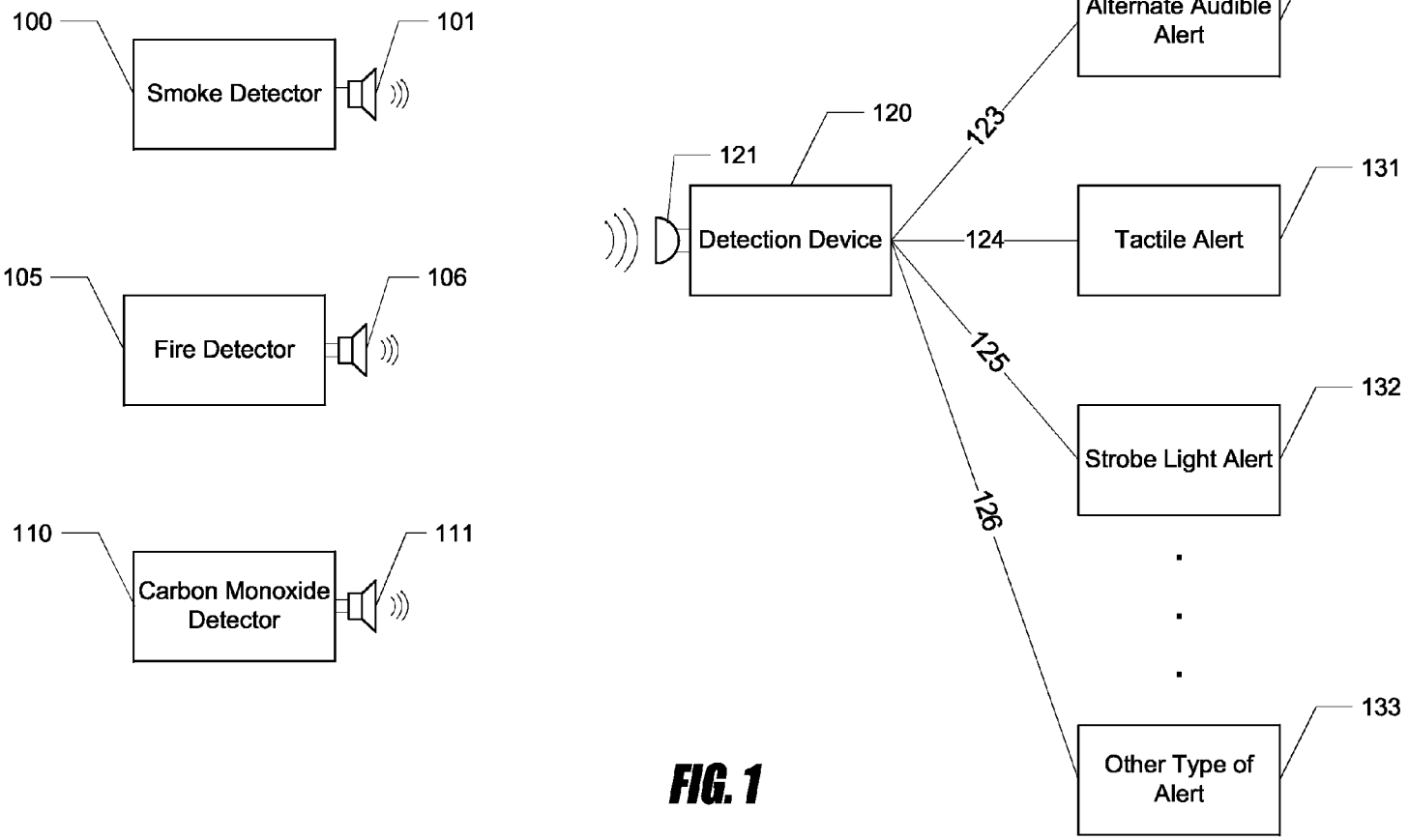
FIGS. 1 and 2 illustrate several different embodiments of a system for detecting and alerting persons to various types of audible alert signals.

FIG. 1 illustrates a system for detecting and alerting individuals to various types of alert signals according to some embodiments. The system can comprise a detection device 120 that is configured to detect audible alert signals, such as audible signals generated by: a smoke detector 100 and output through a speaker 101, a fire detector 105 and output through a speaker 106, and a carbon monoxide detector 110 and output through a speaker 111. The detection device 120 can comprise a microphone or a microphone array 121 configured to detect audio signals. The detection device 120 can, for example, comprise signal processing circuitry configured to determine whether detected audio signals comprise audible alert signals. The signal processing circuitry can, for example, be implemented using a microcontroller, a digital signal processor, a microprocessor, an ASIC, a FPGA, and some combination thereof. In some embodiments, the detection device 120 may be designed to detect only some of the types of audible alarms described herein (e.g., those generated by smoke detectors), and not others.

Upon detecting an audible alert signal, the detection device 120 can be configured to notify or activate alert device or devices. As is illustrated in FIG. 1, alert devices can comprise alternate audible alert devices 130 (such as a generator of a low frequency, e.g., 520 Hz, square wave sound pattern), tactile alert devices 131 (such as a bed shaker), strobe light alert devices 132, and other alert devices 133 (such as a bedside liquid sprayer). The system can additionally or alternatively be configured to take other types of actions to alert the individual to the detected alarm condition. For example, in the case of a wrist-worn device, the system could generate a mild shock. As another example, in the case of a hearing aid, the system could output an audible voice message that notifies the individual of the type of alarm condition detected. As another example, the presence of an alarm condition can be communicated to a monitoring service such a 911 emergency service. The alert signal or signals generated by the system are referred to herein as a supplemental alert signals, as they supplement audible alert signals generated by smoke, fire, and carbon monoxide detectors. Although multiple forms of supplemental alert signals are depicted, in some embodiments the system can be configured to generate a single type of supplemental alert signal.

The detection device 120 can be connected by connections 123, 124, 125, and 126 to the devices configured to generate supplemental alert signals. In some embodiments, these connections can be wired, wireless, network, or a combination of thereof. In some embodiments, each of the connections 123-126 can be of the same type, of a different type, or of several different types.

Figure 2:
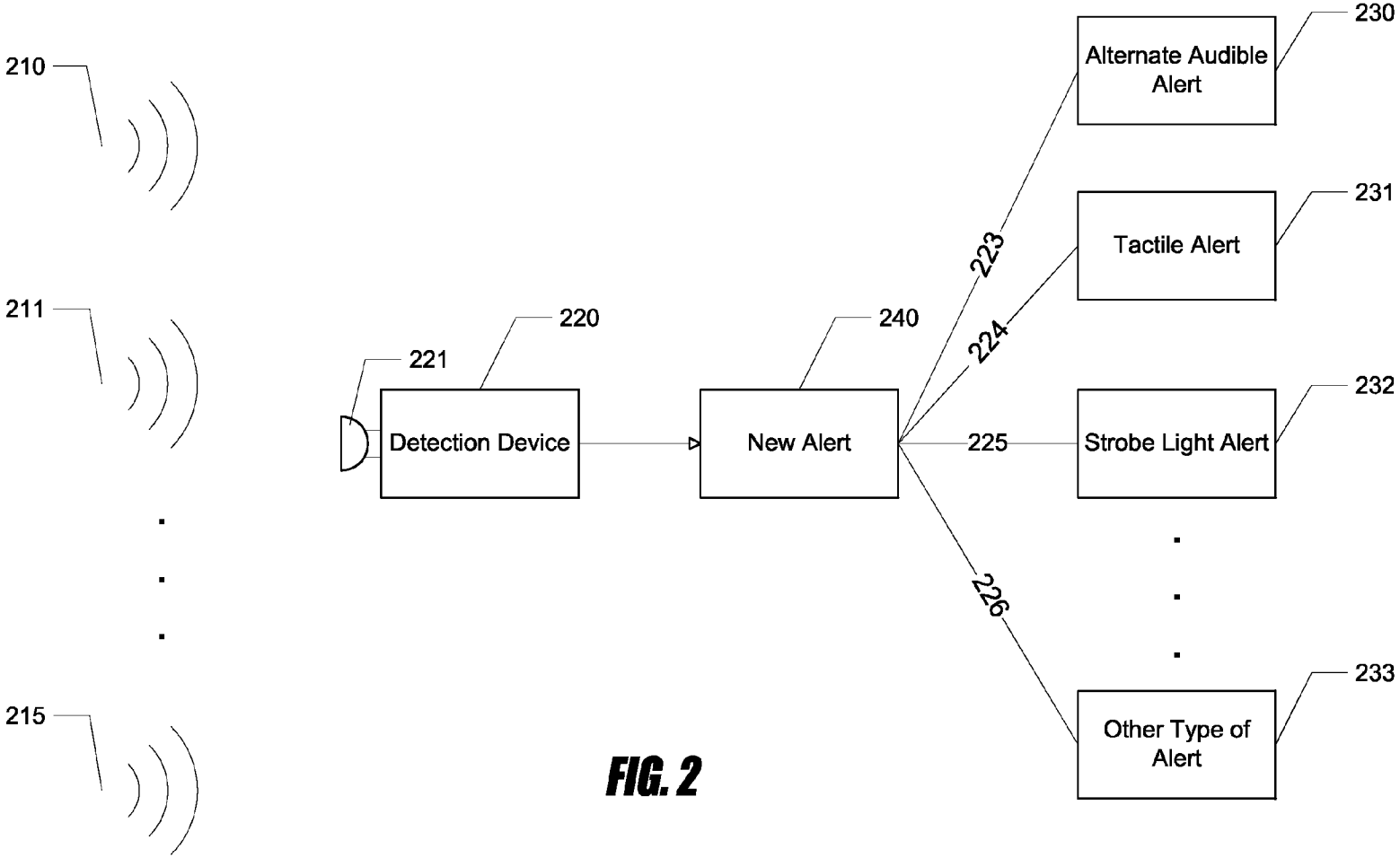

FIG. 2 illustrates a system for detecting and alerting individuals to various types of audible alert signals according to some embodiments. The system can comprise a detection device 220 configured to detect audible alert signals 210, 211, and 212 (e.g., audible alert signals generated by smoke, fire, and carbon monoxide detectors). The detection device 220 can comprise a microphone or a microphone array 221 configured to detect audio signals. As explained above, the detection device 220 can comprise signal processing circuitry (e.g., a signal analyzer) configured to determine whether the detected audio signals comprise audible alert signals.

Upon detecting an audible alert, the detection device 220 can be configured to notify or activate one or more alert devices by generating a "new alert" notification 240, as is illustrated in FIG. 2. Alert devices can comprise alternate audible alert devices 230 (such as a generator of a low frequency, e.g., 520 Hz, square wave sound pattern), tactile alert devices 231 (such as a bed shaker), strobe light alert devices 232, and other alert devices 233 (such as a bedside liquid sprayer). As is described above, the system can additionally or alternatively be configured to take other types of actions to alert the individual to the detected alarm condition. As described above, the detection device 220 can be connected by connections 223, 224, 225, and 226 to devices configured to generate supplemental alert signals. In some embodiments, these connections can be wired, wireless, network, or a combination of thereof. In some embodiments, each of the connections 223-226 can be of the same type, of a different type, or of several different types.

Detection System

Figure 3:
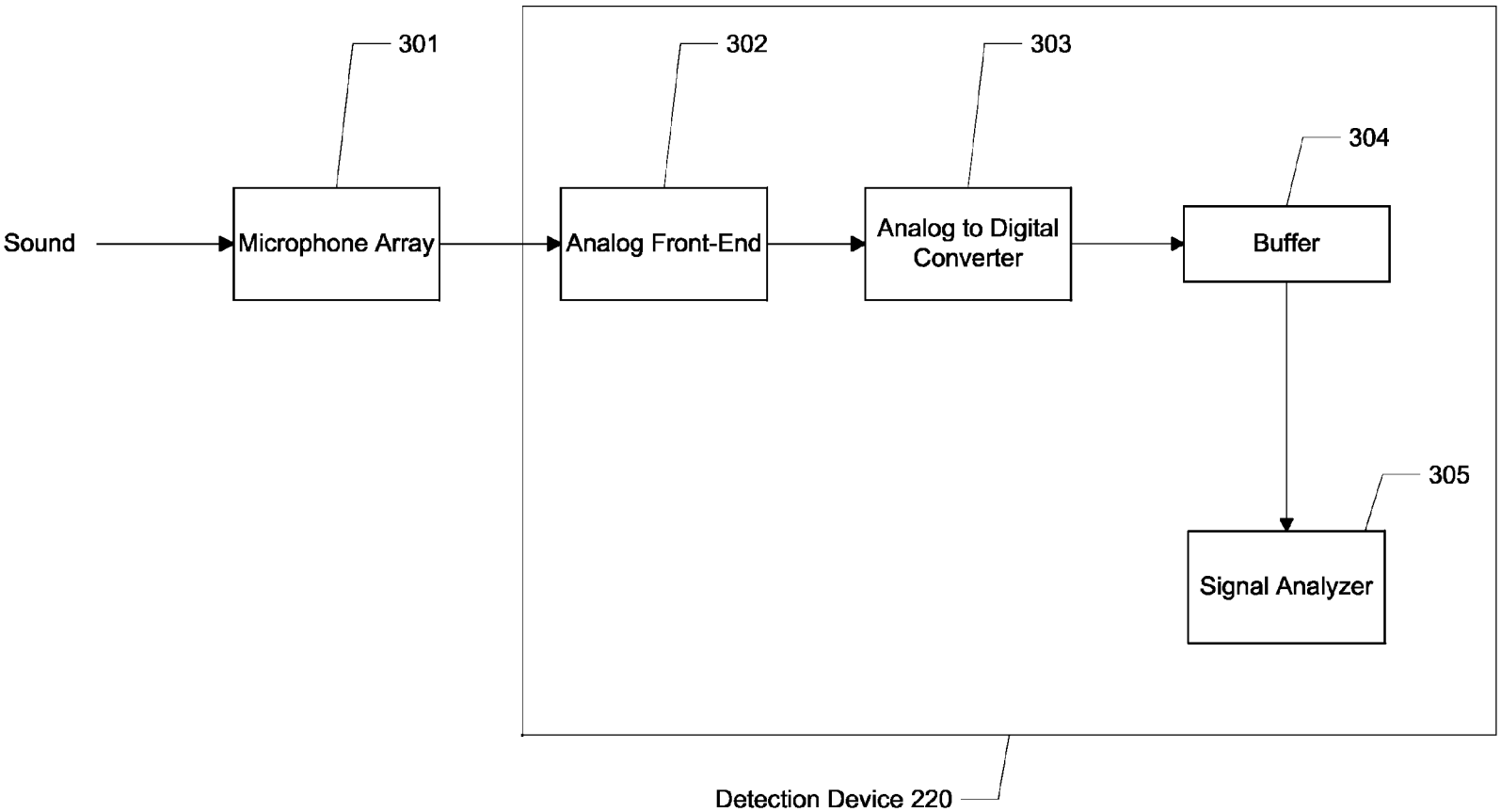
FIG. 3 illustrates an arrangement of hardware and data processing components that may be used in the system for detecting and alerting persons to various types of audible alert signals.

FIG. 3 illustrates a hardware block diagram of the detection device 220 according to some embodiments. A microphone or microphone array 301 converts sound pressure energy from the detected sound or sounds into electromagnetic energy. The resulting electrical signal is passed through an analog front-end 302, which can comprise amplifiers for amplification of the signal, buffers for stabilizing the signal, and filters for limiting the signal's bandwidth. The processed signal is then digitized by an analog to digital converter 303, and the resulting digital samples are stored in a memory buffer 304. In some embodiments, the buffer 304 is arranged as a circular buffer to facilitate processing of the digital samples.

Signal analyzer 305 is configured to repeatedly determine whether the set or subset of digital samples (stored in the buffer 304) of the detected sound comprises audible alert signals. The signal analyzer 305 can further apply a timing window to capture a time slice of the detected sound (i.e., the current time slice) for analyzing and for determining presence of audible alert signals.

As described above, the signal analyzer 305 can include a microcontroller, a digital signal processor, a microprocessor, an ASIC, a FPGA, or some combination thereof, and can include random access memory (e.g., an array of RAM devices) for storing data. The underlying signal analysis algorithms implemented by the signal analyzer 305 may be embodied in executable instructions (firmware or software) executed by a processing device, and/or may be embodied in application-specific circuitry. The executable instructions, if any, may be stored on any type computer-readable medium (e.g., solid state ROM or RAM, magnetic disk storage, etc.) For example, where the algorithms are embodied in-whole or in-part in firmware, the detection device 220 may include a read-only memory (ROM) device (not shown) that stores the firmware code. In some embodiments, the signal analyzer 305 can comprise hardware, firmware, and/or software components other than those described herein.

The detection device 220 can be implemented using small, low cost, and low power components. For example, when the detection device is embodied in a bedside unit, such unit can be capable of providing alert signals for at least 7 days in case of power loss, unplugging, or the like, while operating of battery backup.

Figure 4:
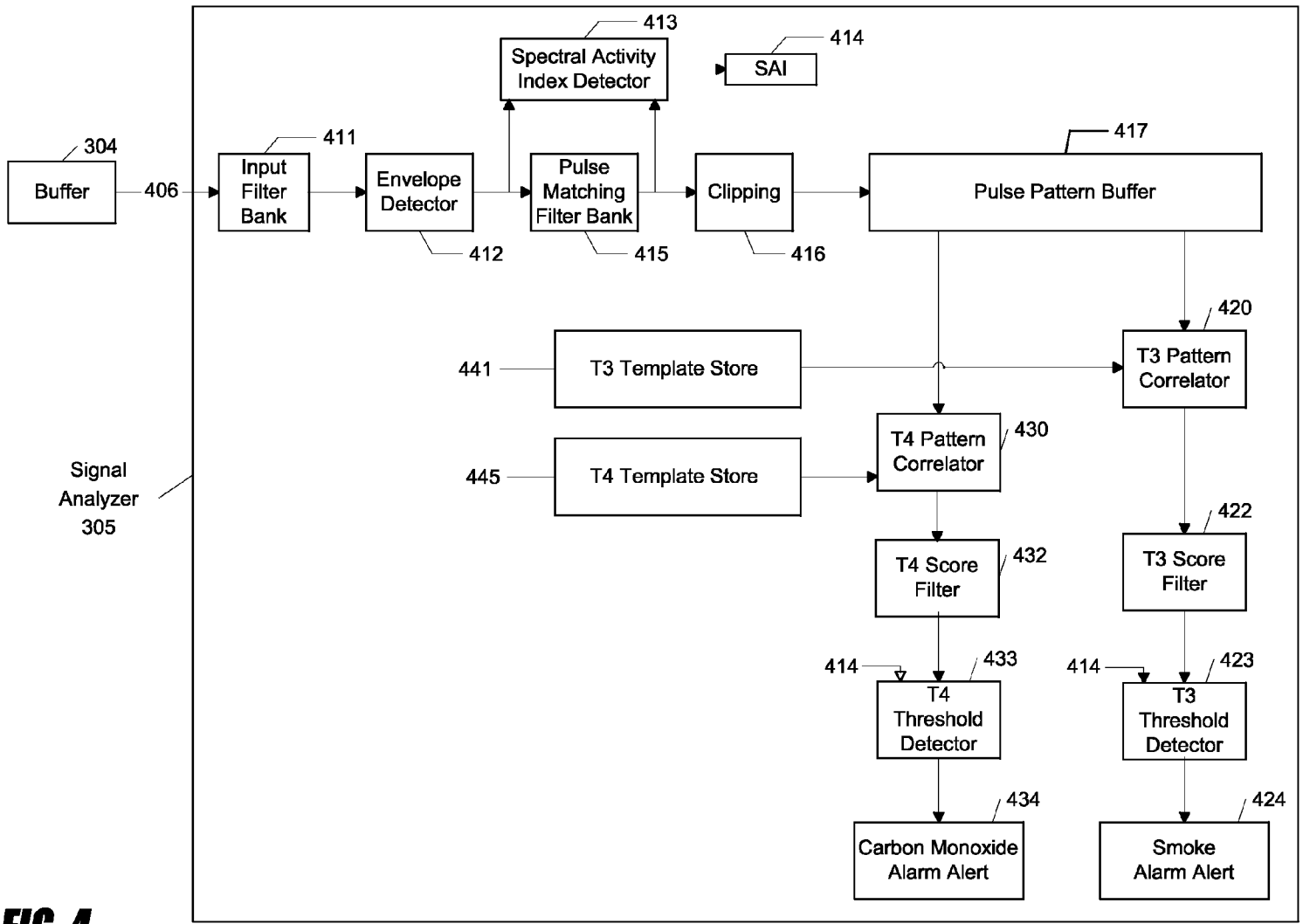
FIG. 4 illustrates an arrangement of hardware and data processing components in a signal analyzer that may be used in the system for detecting and alerting persons to various types of audible alert signals.

FIG. 4 is a functional block diagram of the signal analyzer of FIG. 3 according to some embodiments. Each functional block shown in FIG. 4 is preferably implemented in executable code executed by hardware or firmware, but may alternatively be implemented partly or wholly in application-specific circuitry. As will be apparent, many of the blocks depicted in FIG. 4, and their associated descriptions below, represent implementation details that can be omitted or varied without departing from the scope of the invention. Thus, nothing FIG. 4 or the following description implies that any particular component, characteristic, step, or other feature is essential to the invention.

The system can be configured to detect audible alert signals such as Temporal-3 ("T3") and Temporal-4 ("T4") alert signals generated by home smoke, fire, and carbon monoxide detectors according to existing regulations (e.g., UL 217, UL 464, UL 1971, and UL 2034). T3 audible alert signals, generated by UL compliant smoke and fire detectors, are specified as beeping tones of a 0.5 seconds (±10%) duration (typically, in the 2900-3500 Hz frequency range) followed by 0.5 seconds (±10%) silence. Three alternating beeping tones and silence intervals are followed by 1.5 seconds (±10%) pause. Accordingly, the period of T3 audible alert signal is four seconds (±10%). T4 audible alert signals, generated by UL complaint carbon monoxide detectors, are specified as a single tone pattern consisting of four cycles of 100 msec (±10%) beeping tones (typically, in the 2900-3500 Hz frequency range), interspersed with silence intervals of 100 msec (±10%), and followed by 5 seconds (±10%) of silence. Accordingly, the period of T4 audible alert signal is 5.8 seconds (±10%).

The signal analyzer 305 is capable of reliably detecting (with high sensitivity and high specificity) T3 and T4 audible alert signals generated by commercially available home smoke, fire, and carbon monoxide detectors. In some embodiments, the signal analyzer 305 can be configured to detect T3 and T4 audible alert signals with intensity as low as 3 dB SNR (where SNR stands for the signal-to-noise ratio). Moreover, in some embodiments the signal analyzer 305 can be configured to detect T3 and T4 audible alert signals in the presence of background environments of varying intensity.

In some embodiments, the signal analyzer 305 can be implemented in an ARM7 family microprocessor (low power 32-bit RISC architecture). In such embodiments, the signal analyzer 305 can be implemented in approximately 16 KB of program code and approximately 26 KB of data space.

As is illustrated in FIG. 4, digital audio input data 406 (i.e., digitized samples of audio input signal), stored in the buffer 304, serves as an input to the signal analyzer 305. In some embodiments, the audio input data 406 can comprise a block of 1024 audio samples, sampled at 11.025 KHz. Accordingly, the block update rate is 10.77 Hz (11.025 KHz/1024). In some embodiments, an interrupt service routine provided by an operating system of a processor (e.g., ARM7 family microprocessor) can collect samples represented as 16-bit signed integer values from the analog-to-digital converter 303 (shown in FIG. 3) and store the samples in the buffer 304. A flag can be set indicating that a new block of audio data samples is ready for processing, and a detector processing routine can be executed. Other block sizes and sampling rates can be used in accordance with the desired reliability, speed, and power consumption of the signal analyzer 305.

Figure 5A:
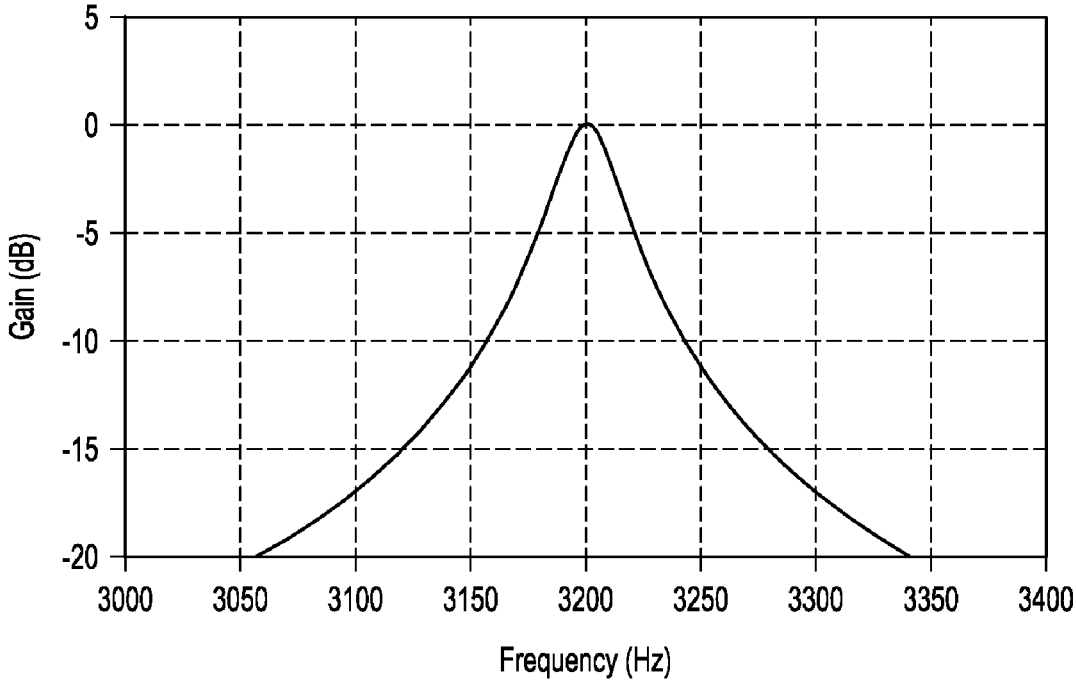
FIG. 5 illustrates a frequency response of an input filter bank of the signal analyzer of FIG. 4.
Figure 5B:
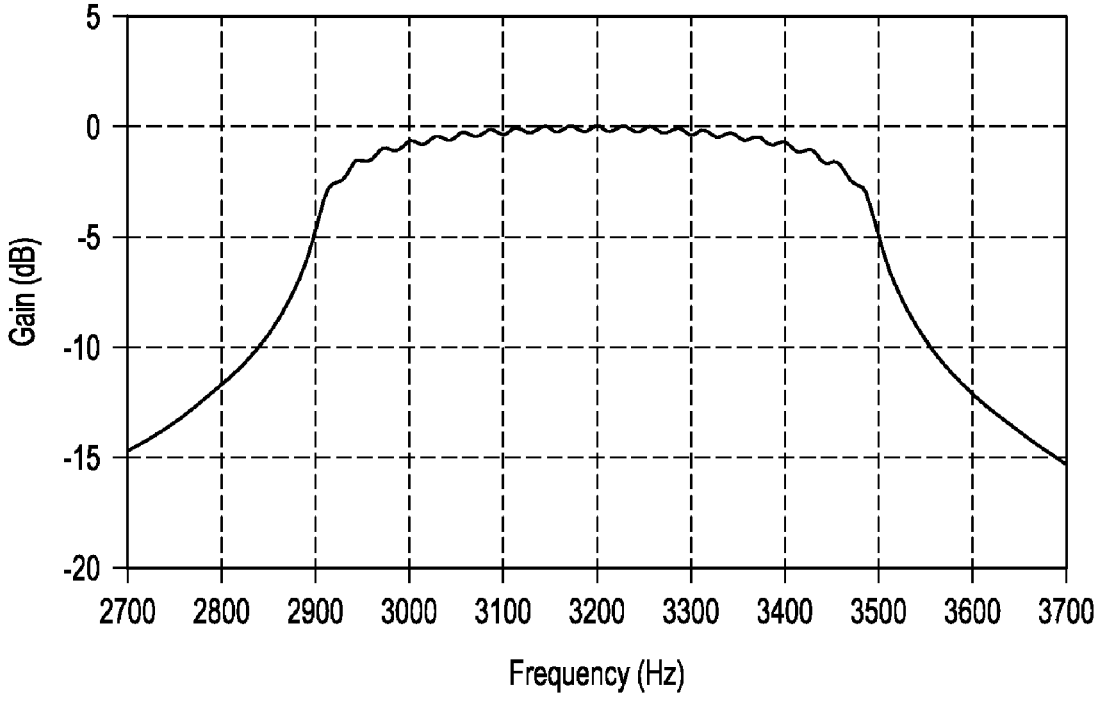

The audio input data 406 is filtered by an N-channel input filter bank 411. The filter bank 411 can be configured to comprise N bandpass narrow band filters covering the range of interest (e.g., 2900-3500 Hz frequency range of T3 and T4 alert signals). The higher the number N of filters in the filter bank 411, the more reliable, but more memory and processing intensive, the signal analyzer 305 can be. In some embodiments, twenty-one filters (N=21) can be used, each covering a bandwidth of 28.6 Hz ((3500-2900) Hz/21). In some embodiments, the filter bank 411 is implemented using N two-pole resonators, each having a center frequency placed approximately in the middle of the respective frequency channel (i.e., center frequencies are spaced out evenly over the entire range of interest) and a Q-factor set for an effective filter bandwidth of 28.6 Hz. For example, FIG. 5A illustrates the frequency response of a filter (center frequency=3200 Hz) comprised by the filter bank 411, and FIG. 5B illustrates the cumulative frequency response of the filter bank 411 (N=21).

Testing has demonstrated that commercially available smoke, fire, and carbon monoxide detectors generate T3 and T4 audible alert tones that drift from the overall specification governed by the existing regulations and, additionally, drift between consecutive beeping tones. Accordingly, configuring the input filter bank 411 to an approximately 30 Hz bandwidth of each channel can facilitate reliable detection of T3 and T4 audible alert signals. However, a different number of channels in the filter bank and different types of filters can be used by the signal analyzer 305 in order to trade off reliability for processing speed, memory usage, and power consumption. For example, testing has demonstrated that the number of channels (N) for the reliable detection of T3 and T4 audible alert signals can be in the range of 10-30, and more preferably at least 20. Accordingly, the channel bandwidth is preferably 20-60 Hz, and more preferably at most 30 Hz Input filter bank 411 configuration with less than ten channels can cause a loss of sensitivity of the signal analyzer 305 due to the drift of T3 and/or T4 tones. Conversely, selecting more than thirty channels can provide negligible incremental improvements in the reliability of detection, while causing the signal analyzer 305 to use more processing resources, memory, and power. However, the number of channels may increase over time as advances in technology lead to increased processing speeds, more dense, capacious memory modules, and lower power consumption.

Audio data processed by the input filter bank 411 is passed through an envelope detector 412, which estimates the amplitude (or energy) of the audio signal on each channel. The envelope detector 412 can be configured to estimate the amplitude on each of N channels. In some embodiments, amplitude detection is performed by summing absolute values of the filtered audio samples. This has the effect of downsampling the audio input data from the sampling rate to the block update rate (i.e., N envelope estimates are computed). For example, if there are twenty-one filters (N=21) in the filter bank 411 and audio input data 406 comprises a block of 1024 samples sampled at 11.025 KHz, the envelope detector 412 may output 21 amplitude estimates at a block update rate of 10.77 Hz (11.025 KHz/1024). In some embodiments, the estimated amplitude values can be placed into a buffer (such as a circular buffer) in order to collect a frame of amplitude values on which the remaining detection steps will be performed. For example, a 33-second frame can be buffered, which corresponds to approximately 356 (33×10.77) amplitude estimates on each channel (e.g., a 21×356 matrix of amplitude estimates). In some embodiments, the audio input data may not be downsampled. For example, the amplitude of each sample can be computed without performing a summation operation and the resulting output can be 1024 amplitude estimates on each of N channels (e.g., a 21×1024 matrix of amplitude estimates). In some embodiments, other mathematical operations such as squaring the sample values, summing the squared sample values, weighing the squared samples, etc., can be performed for estimating the amplitude of the audio signal.

Figure 6:
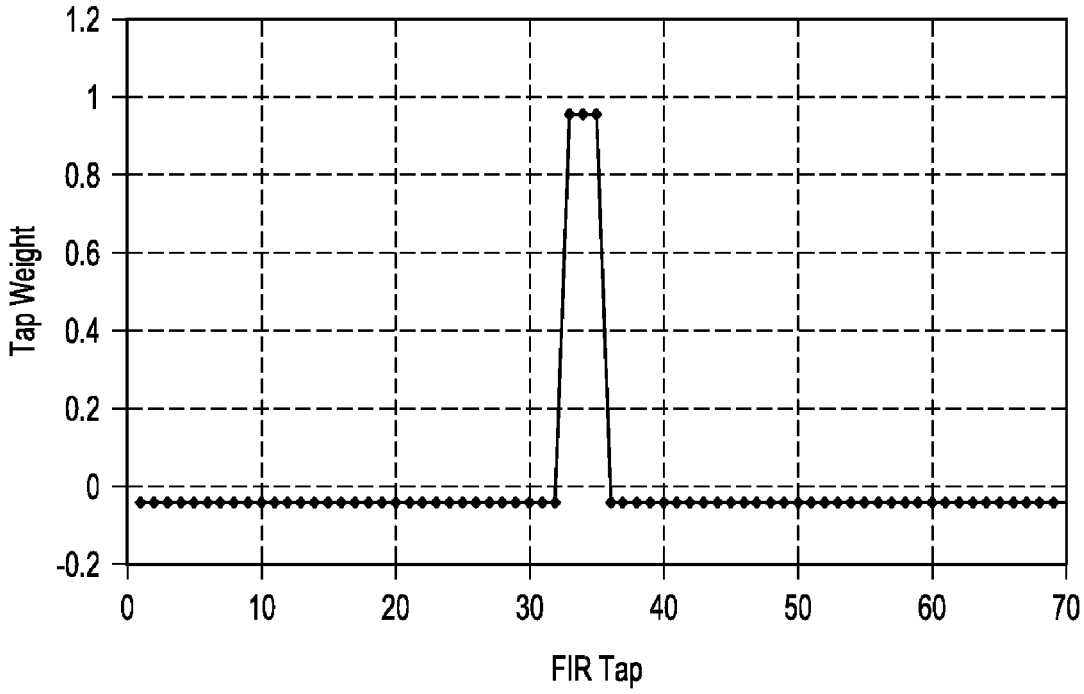
FIG. 6 illustrates an impulse response of a pulse matching filter bank of the signal analyzer of FIG. 4.

The output of the envelope detector 412 is passed through an N-channel pulse matching filter bank 415. The pulse matching filter bank 415 can be configured to enhance pulses that have the expected duration of T3 and T4 audible alarm tones, and to remove constant (i.e., DC) background. For example, T3 beeping tones have the expected duration of 0.5 seconds with a variance of approximately ±20%, as has been determined by testing. T4 beeping tones have the expected duration of 100 msec with a smaller variance, since T4 audible alert signals are typically generated by more accurate microprocessor-based carbon monoxide detectors. The pulse matching filter bank 415 can be configured to have a response function that matches the length of the shortest expected tone, the length of the average expected tone, the length of the longest expected tone, and the like. The response function of the filters in the pulse matching filter bank 415 can be configured as a square wave with a negative offset, as to remove the DC components. In some embodiments, the filter function of each channel of the matching filter bank 415 is configured as a 69-tap FIR bandpass filter, having as it impulse response a single 280 msec long positive square pulse. The impulse response also includes a negative offset to remove any DC components. FIG. 6 illustrates an impulse response of the matching filter bank 415 according to some embodiments.

When the audio input data 406 comprises a block of 1024 samples sampled at 11.025 KHz, such impulse response function covers about 6.5 seconds of the envelope detector 412 output (69×1024/11025), which corresponds to approximately 1.5 periods of the T3 audible alarm signal and approximately 1 period of the T4 audible alarm signal. Accordingly, configuring the impulse response function to have 69 taps facilitates reliable detection. In some embodiments, a different impulse response function can be selected for each channel in the pulse matching filter bank 415 or groups of channels can share the same impulse response function.

The output of the envelope detector 412 and of the pulse matching filter bank 415 can be provided to a spectral activity index detector 413, which is configured to calculate a spectral activity index ("SAI") value 414. The SAI value is a ratio of the energy of the dynamic (AC) portion of the audio data to the energy of the total audio data signal (DC portion). In some embodiments, the spectral activity index value 414 can be calculated as a scaled ratio of the cumulative AC output of the pulse matching filter bank 415 to the cumulative DC output of the signal filtered by the input filter bank 411 and amplitude estimated by the envelope detector 412. In some embodiments, the cumulative DC and AC output can be computed as an average of the samples, a weighted average of the samples, a scaled average of the samples, or the like.

In some embodiments, the cumulative DC output can be computed as averaged amplitude estimates for a channel. For example, when the input filter bank is configured to output N=21 channels of 1024 filtered input audio data samples, and when this data is passed through the envelope detector 412 and is, optionally, further buffered (into a frame of M amplitude estimate samples) as explained above, the cumulative DC output can be computed as:

$$\overline{DC_k} = \frac{1}{M}\sum_{n=1}^{M}|x_k(n)|,\ k \in [1, N]$$

where $x_k(n)$ is the value of the nth filtered sample on channel k. In some embodiments, the cumulative DC output can be computed as an average across all N channels:

$$\overline{DC'} = \frac{1}{N}\sum_{k=1}^{N}\overline{DC_k}$$

Furthermore, the output of the pulse matching filter bank 415 can be used to compute the cumulative AC output because, as explained above, the pulse matching filter bank 415 can be configured to remove DC components (and thus retain AC components). For example, when the envelope detector 412 is configured to downsample the estimated amplitude values to a block update rate of 10.77 Hz and the amplitude estimates are further buffered (into a frame of M amplitude estimate samples) as explained above, the cumulative AC output can be computed as:

$$\overline{AC_k} = \frac{1}{M}\sum_{n=1}^{M}|y_k(n)|,\ k \in [1, N]$$

where $y_k(n)$ is the value of the nth pulse matching filtered sample on channel k. In some embodiments, the cumulative AC output can be computed as an average across all N channels:

$$\overline{AC'} = \frac{1}{N}\sum_{k=1}^{N}\overline{AC_k}$$

In some embodiments, the SAI value 414 (unscaled or scaled) can be computed as follows:

$$\sum_{k=1}^{N}\frac{\overline{AC_k}}{\overline{DC_k}},$$

$$\frac{1}{N}\sum_{k=1}^{N}\frac{\overline{AC_k}}{\overline{DC_k}},$$

$$100\sum_{k=1}^{N}\frac{\overline{AC_k}}{\overline{DC_k}},$$

$$\frac{100}{N}\sum_{k=1}^{N}\frac{\overline{AC_k}}{\overline{DC_k}},$$

$$\frac{100}{N}\sum_{k=1}^{N}\frac{\overline{AC_k}}{\overline{DC_k}},\ \frac{\overline{AC'}}{\overline{DC'}}\ \text{etc.}$$

The cumulative DC and AC output and SAI value can be computed using other techniques (e.g., weighting of samples), as will be understood by a person of ordinary skill in the art from the disclosure herein.

As explained below, the SAI value 414 can be used to reject background music, television signals, and other audible signals having frequency characteristics and periodicity similar to T3 and T4 audible alert signals. The SAI value 414 can be used to readjust the signal analyzer 305 to reduce the occurrence of false alarm conditions or to detect faint T3 and/or T4 audible alarm signals.

The output of the pulse matching filter bank 415 can be clipped (i.e., limited to a range of values) by a clipper 416. In some embodiments, the envelope data from the pulse matching filter bank 415 can be hard clipped to +1 for all zero or positive values and to −1 for all negative values. In some embodiments, the clipper 416 can be configured to restrict values to a wider range of values. In some embodiments, the clipper 416 can be configured to perform soft clipping.

The output of the pulse matching filter bank 415 can be stored in a pulse pattern buffer 417, in order to collect a frame of the processed audio signal. In some embodiments, the last 33 seconds of each channel of processed audio input data (e.g., the last 356 amplitude estimates downsampled to 10.77 Hz) can be stored in the pulse pattern buffer 417 and serve as the frame. Thirty-three seconds capture about eight periods of T3 audible alert signal and about 6.5 periods of T4 alert signal. In some embodiments where the input filter bank is configured to with N=21 channels, the pulse pattern buffer 417 can be configured to store twenty-one channels of 33 seconds of audio input data (e.g., the pulse pattern buffer 417 can be configured as a 21×356 matrix of samples, comprised by the frame). Furthermore, the pulse pattern buffer 417 can be configured as an N-channel circular buffer where the oldest stored processed audio signal samples are replaced by new samples. In some embodiments, the pulse pattern buffer 417 can be configured to store a configurable frame length. For example, the frame can be 10 seconds long or about 2.5 periods of the T3 alert signal and two periods of the T4 alert signal. As another example, the frame length can be 20 seconds, or about five periods of the T3 alert signal and four periods of the T4 alert signal. By configuring the pulse pattern buffer 417 to store a longer frame, the signal analyzer 305 can trade off a longer time of detection of audible alert signals for a more reliable (i.e., high sensitivity and high specificity) detection.

As will be appreciated, blocks 411-417 in FIG. 4 represent just one many possible ways in which the digitized audio signal can be processed to generate a buffered pulse pattern to be analyzed. Numerous variations to this pre-analysis signal path are possible.

Detection of Audible Smoke and Fire Alarm Signals

In the illustrated embodiment, the signal analyzer 305 detects T3 audible alert signals by matching the detected pulse patterns stored in pulse pattern buffer 417 with a set of expected T3 audible alert signal templates stored in a T3 template store 441. The template store 441 stores templates of T3 audible alert signals covering variations in the temporal pattern of the T3 signal, such as in the period of the T3 signal (i.e., overall signal drift), in the duration of the beeping tone of the T3 signal, in the duration of the silence interval of the T3 signal, in the duration between the adjacent samples (i.e., tone to tone signal drift), in the signal intensity (e.g., due to the background environment, the proximity of the smoke or fire detector to the detection device, etc.), and on the like. The number of template patterns in the template store 441 can be configured to provide reliable detection of T3 audible alert signals. A higher number of template patterns typically directly correlates with the reliability of detection and inversely correlates with the speed of detection, memory usage, and power consumption. Preferably, the number of template patterns is at least 10, and more preferably at least 20.

Figure 7:
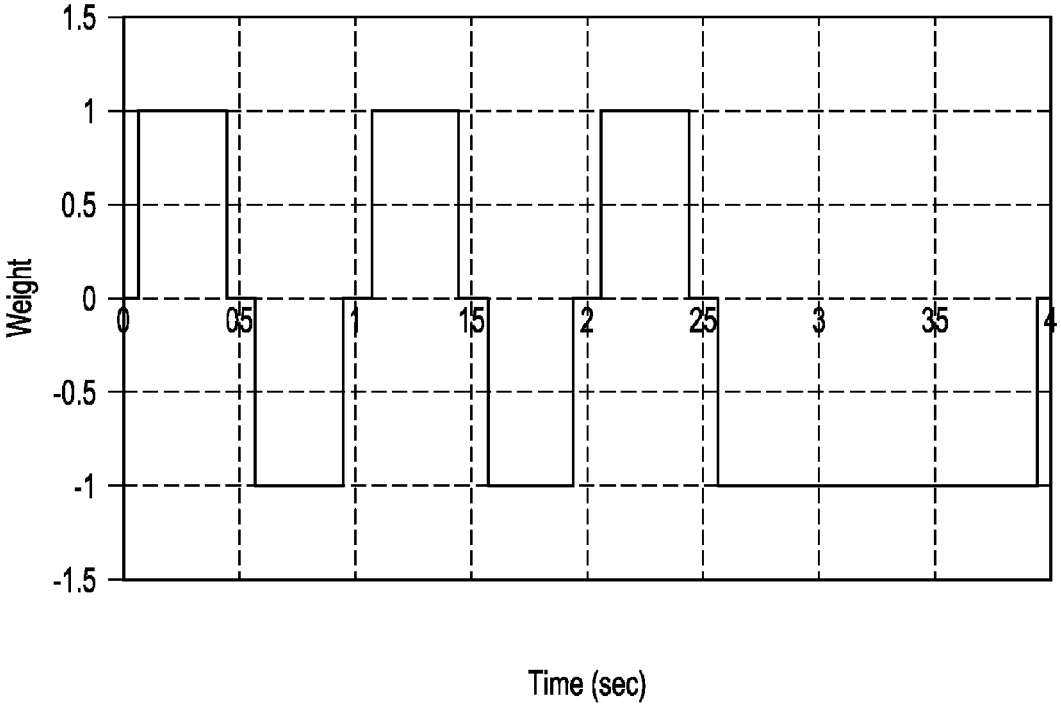
FIG. 7 illustrates a Temporal-3 template pattern of the signal analyzer of FIG. 4.

In some embodiments, the template store 441 comprises 25 pre-calculated template patterns covering the range of [−18%, 30%] variation in the four second period of the T3 audible alert signal (i.e., covering the period range of [3.28, 5.2] seconds). Consequently, each template covers approximately a 2% deviation (i.e., 80 msec) in the four second period of the T3 audible alert signal, as specified by the existing regulations. For example, FIG. 7 illustrates a template pattern corresponding to the nominal 4 seconds T3 beeping tone pattern. In some embodiments, the template store 441 can have a smaller or greater number of template patterns corresponding respectively to a broader or narrower range of temporal pattern variations of the T3 audible alert signal.

In some embodiments, a T3 pattern correlator 420 matches the detected pulse patterns with a template or templates stored in the T3 template store 441. For example, each channel of processed audio input data frame stored in the pulse pattern buffer 417 can be compared with each template stored in the T3 template store 441, and a matching score can be computed. In some embodiments, the matching score is computed as a number of samples in the pulse pattern buffer 417 that correspond to or match the respective samples in the template. For example, a match occurs when:

$$\text{pulse_pattern_buffer}[n]=\text{template}_i[m]$$

where $\text{template}_i$ is the ith template in the store 441, pulse_pattern_buffer is a frame of the processed audio signal, and n, m are samples. In some embodiments (as is shown in FIG. 7), a match can be assigned a score of 1 and no match can be assigned a score of −1. Then, the matching score, for example, can be computed as a sum of matches. As another example, the matching score can be computed as a sum of matches and non-matches, with the latter being subtracted from the score and thus functioning as a penalty. In some embodiments, a matching score can be expressed as a percentage of matches. For example, a matching score of 100% can indicate a perfect match of the pulse pattern with a template. As another example, a matching score of 50% can indicate that one half of pulse pattern values matched the template values. Testing has demonstrated that processing of random noise audio input data typically produces a 50% matching score. Processing of T3 audible alert signals generated in typical background environments usually produces a matching score of 70-90%.

As described above, in some embodiments as described above, pulse patterns stored in the pulse pattern buffer 417 are hard clipped to +1 for all zero or positive values and to −1 for all negative values. The templates stored in the T3 template store 441 can then have a +1 value corresponding to the time when a beeping tone is expected to be present and a −1 value when a beeping tone is not expected to be present in the T3 audible alert signal (e.g., FIG. 7). In some embodiments (e.g., FIG. 7), the templates stored in the T3 template store 441 comprise "don't care values" to provide an additional tolerance to the variation of the processed audio input data from the expected characteristics of the T3 audible alert signal governed by the existing regulations. For example, don't care values can be set to zero so that the matching score is not affected.

In some embodiments, matching scores are separately computed for multiple time segments of the processed audio input data stored in the pulse pattern buffer 417. For example, matching scores can be computed for the first and second full T3 audible alert signal periods (i.e. the first 4 seconds and the first 8 seconds) to improve the reliability of detection, as explained below. As another example when the pulse pattern buffer 417 is configured to store 33 seconds of the processed audio input data (or about eight periods of T3 audible alert signal), the T3 pattern correlator 420 can be configured to calculate scores for the first three T3 alert signal periods (i.e. the first 12 seconds), the first four T3 alert signal periods (i.e. the first 16 seconds), and the first six T3 alert signal periods (i.e. the first 24 seconds). In this example, the T3 pattern correlator 420 calculates, for each template, matching scores for three time segments. The T3 pattern correlator 420 can be configured to calculate matching scores for other combinations of consecutive and nonconsecutive time segments. In some embodiments, the T3 pattern correlator 420 can be configured to calculate a matching score on the entire segment of the processed audio input data frame.

In some embodiments, the T3 pattern correlator 420 selects a number of highest matching scores from the set of computed scores and discards the remaining matching scores. For example, the T3 pattern correlator 420 can select the best score from the matching scores computed by comparing a given template to each channel of the processed audio data. As another example, the T3 pattern correlator 420 can select the best matching score from the set of scores computed by comparing a given template to each channel, and further for multiple time segments. As described above, in some embodiments matching scores are computed for the first three, the first four, and the first six T3 alert signal periods for each of N channels (e.g. 21 channels) of the processed audio input data and for each templates (e.g. each of the 25 templates). The total number of matching scores would then be 1575 (25×21×3). As described above, a maximum matching score can be selected from the set of 25 scores computed by comparing each template to the processed input data for each channel and further for each time segment. The output of the T3 pattern correlator would then be 63 (21×3) best matching scores for each time segment on each channel. In some embodiments, the T3 pattern correlator 420 selects the second best score, the third best score, and the like, or selects a set of best matching scores, whether consecutive or not.

In some embodiments, the matching scores computed by the T3 pattern correlator 420 are further processed by a T3 score filter 422 in order to remove matches for common sounds that closely mimic the T3 audible alert signals. For example, some background music or television signals have frequency characteristics and periodicity that closely match T3 alert signals. Such signals are referred to herein as "mimic signals." Mimic signals can cause the T3 pattern correlator 420 to mistakenly output large matching scores even though a T3 alert signal is not present in the audio input data. Valid T3 audible alert signals typically create distinct patterns of matching scores, such as a single high matching score occurring every T3 alert signal period (i.e. every four seconds). Most mimic signals do not exhibit such regularity of the matching scores because mimic signals do not possess the exact periodic characteristics of the T3 alert signal.

The T3 score filter 422 analyzes the temporal pattern of matching scores and rejects mimic signals. In some embodiments, for example, the T3 score filter verifies that only one primary score peak occurs every T3 alert signal cycle by examining the time sequence of the matching scores across the channels of the processed audio data. Within a T3 alert signal cycle, mimic signals typically comprise multiple high matching scores present on different channels; thus the T3 score filter 422 can detect and reject such mimic signals. In some embodiments, the T3 score filter 422 can reject mimic signals by subtracting a penalty factor from the matching score of the processed audio input data that exhibits characteristics of mimic signals. In some embodiments, the T3 score filter 422 can reject mimic signals by analyzing the temporal pattern of matching scores computed on multiple time segments of the processed audio input data. For example, the T3 score filter 422 can verify that only one primary score peak occurs during each period of the first three, the first four, and the first six T3 alert signal periods. In some embodiments, the T3 score filter 422 is not used.

A T3 threshold detector 423 determines whether the processed audio input data comprises the T3 audible alert signal. This determination can be made by comparing the matching score or scores computed by the T3 pattern correlator 420, and processed by the T3 score filter 422, to one or more threshold matching scores. In some embodiments, the highest matching score is compared to a threshold. In some embodiments, a set of best matching scores is compared to a set of threshold matching scores. In some embodiments, the highest matching scores or a set of highest matching scores, computed for multiple time segments of the processed audio input data, are compared to a set of threshold matching scores. For example, and as explained above, the T3 threshold detector 423 can compare the best matching scores computed for the first three, the first four, and the first six T3 audible alert signal periods to a set of thresholds. The use of multiple time segments can provide a rapid detection of strong alert signals, while also allowing for detection of faint alert signals. In some embodiments, the T3 threshold detector 423 generates a smoke alarm alert notification 424 when at least one comparison to the threshold produces a match. As is illustrated in FIG. 2, alert device or devices configured to generate supplemental alert signals can then be notified or activated.

Figure 9:
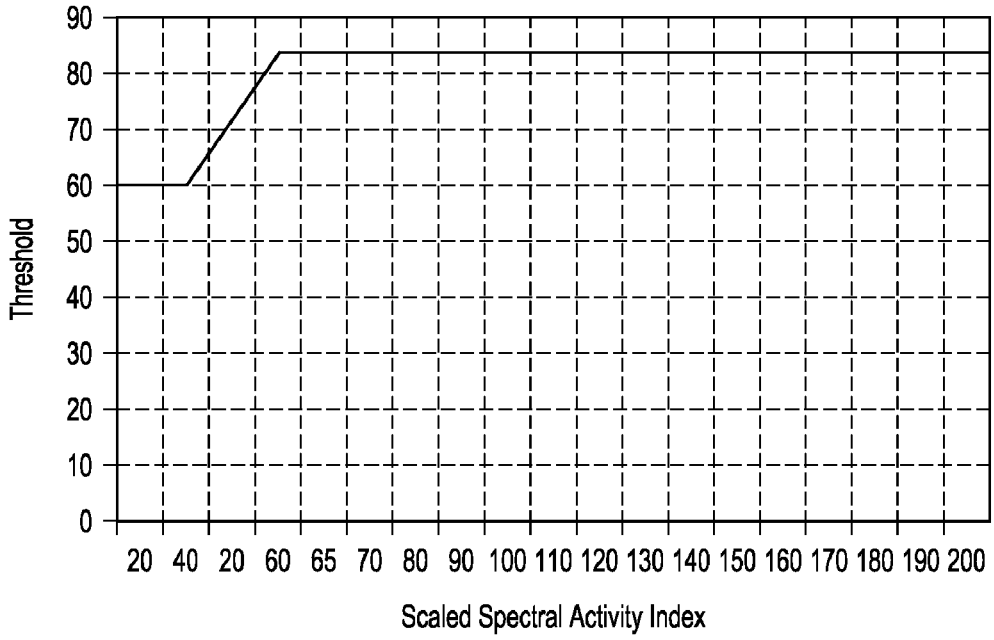
FIG. 9 illustrates an adjustment of a detection threshold of the signal analyzer of FIG. 4.

In some embodiments, the T3 threshold detector 423 automatically adjusts in order to reduce the occurrence of false alarm conditions or to detect faint T3 audible alarm signals. The computed SAI value 414 can be used to reject strong background music, television signals, and other audible signals having frequency characteristics and periodicity similar to T3 audible alert signals. For example, when the background environment is quiet, the SAI value 414 tends to be low (e.g., 0.1 for random white noise background). When the background environment contains strong musical content, the SAI value 414 tends to be high (e.g., 0.3-0.6). Accordingly, the SAI value 414 can be used to automatically readjust the threshold of the T3 threshold detector 423. For example, increasing the threshold for high SAI values can facilitate the reduction of false alarm conditions at the expense of making the signal analyzer 305 less sensitive. Conversely, decreasing the threshold for low SAI values can facilitate the detection of faint T3 audible alarm signals and make the signal analyzer 305 more sensitive. For ease of computation, the SAI value can be scaled by a factor of 100 in some embodiments. FIG. 9 illustrates the adjustment of the detection threshold based on the scaled SAI value 414 according to some embodiments. The illustrated detection threshold is linearly increased when SAI value increases from 40 to 60.

Detection of Audible Carbon Monoxide Alarm Signals

With further reference to FIG. 4, in some embodiments, the signal analyzer 305 is additionally or alternatively configured to detect T4 audible alert signals. Such detection is similar to the detection of T3 audible alert signals explained above. However, as explained above, T4 audible alert signals are typically generated by more accurate microprocessor-based detectors, and, thus, have a smaller variance from the specifications of the T4 audible alert signal governed by the existing regulations.

The signal analyzer 305 can match the detected pulse patterns stored in the pulse pattern buffer 417 with a set of expected T4 audible alert signal templates stored in the T4 template store 445. The template store 445 can store templates of T4 audible alert signals covering variations the temporal pattern of the T4 signal, such as in the period of the T4 signal (i.e. overall signal drift), in the duration of the beeping tone of the T4 signal, in the duration of the silence intervals of the T4 signal, in duration between the adjacent samples (i.e. tone to tone signal drift), in the signal intensity (e.g., due to the background environment, the proximity of the carbon monoxide detector to the detection device, etc.), and so on. Preferably, the number of template patterns is at least 5, and more preferably at least 10. In some embodiments, the template store 445 comprises 11 pre-calculated template patterns covering the range of [−15%, 15%] variation in the 5.8 second period of the T4 audible alert signal governed by the existing standards (i.e. covering the period range of [4.25, 5.75] seconds). Consequently, each template covers approximately a 2.7% deviation (135 msec) from the 5.8 second period of the T4 audible alert signal, as specified by the existing regulations. The template store 445 may alternatively have a smaller or greater number of template patterns corresponding respectively to a broader or narrower range of variation of the T4 audible alert signal period.

Figure 8:
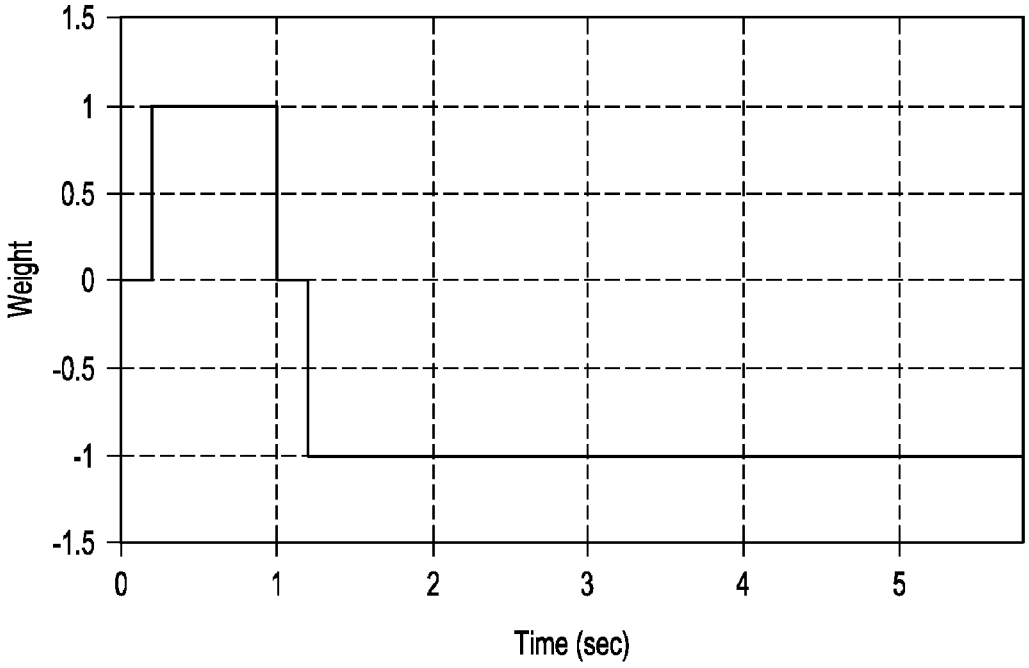
FIG. 8 illustrates a Temporal-4 template pattern of the signal analyzer of FIG. 4.

In some embodiments, T4 template patterns are simplified to treat the four short beeping tones of the T4 audible alert signal interspersed by short silence intervals as one beeping tone. This approximation can better fit the detected audio signal resulting from the temporal spreading of the audible alert signal as it travels down hallways and through doorways when the microphone or microphone array is placed at a substantial distance away from the carbon monoxide detector. For example, FIG. 8 illustrates such a template pattern, which corresponds to the combined beeping tone interval of approximately 0.8 sec long (delayed by about 0.2 seconds from the signal specified by the existing regulations).

In some embodiments, a T4 pattern correlator 430 matches the detected pulse patterns with a template or set of templates stored in the T4 template store 445. For example, each channel of processed audio input data frame stored in the pulse pattern buffer 417 can be compared with each template stored in the T4 template store 445, and a matching score can be computed. In some embodiments, the matching score can be computed as a number of samples in the pulse pattern buffer 417 that correspond to the respective in time samples in the template. For example, a match occurs when:

$$\text{pulse_pattern_buffer}[n]=\text{template}_j[m]$$

where $\text{template}_j$ is the jth template in the store 445 and n, pulse_pattern_buffer is a frame of the processed audio signal, and n and m are samples. In some embodiments (as is shown in FIG. 8), a match can be assigned a score of 1 and no match can be assigned a score of −1. Then, the matching score, for example, can be computed as a sum of matches. As another example, the matching score can be computed as a sum of matches and non-matches, with the latter being subtracted from the score and thus functioning as a penalty. In some embodiments, as described above, a matching score can be expressed as a percentage of matches.

As described abovein some embodiments as described above, pulse patterns stored in the pulse pattern buffer 417 are hard clipped to +1 for all zero or positive values and to −1 for all negative values. The templates stored in the T4 template store 445 can then have a +1 value corresponding to the time when a beeping tone is expected to be present and a −1 value when a beeping tone is not expected to be present in the T4 audible alert signal (e.g., FIG. 8). In some embodiments (e.g., FIG. 8), the templates stored in the T4 template store 441 comprises "don't care values" (e.g. zero values) to provide an additional tolerance to the variation of the processed audio input data from the expected characteristics of the T4 audible alert signal governed by the existing regulations.

In some embodiments, the T4 pattern correlator 430 calculates a matching score on the entire segment of the processed audio input data. For example, if a set of eleven T4 templates is used, a matching score can be computed by comparing each of the eleven templates stored in the T4 template store 445 with each channel of the processed audio input data frame stored in the pulse pattern buffer 417. In some embodiments, matching scores are separately computed for multiple time segments of the processed audio input data frame stored in the pulse pattern buffer 417. The T4 pattern correlator 430 may calculate matching scores for other combinations of consecutive and nonconsecutive time segments.

In some embodiments, the T4 pattern correlator 430 selects a number of highest matching scores from the set of computed scores and to discard the remaining matching scores. For example, the T4 pattern correlator 430 can select the best score from the matching scores computed by comparing a given template to each channel of the processed audio data. As another example, the T4 pattern correlator 430 can select the best matching score from the set of scores computed by comparing a given template to each channel, and further for multiple time segments. As described above, in some embodiments matching scores are computed by comparing each of the templates (e.g., 11 templates) stored in the T4 template store 445 with each of N (e.g., 21) channels of the processed audio input data frame (e.g., 33 seconds) stored in the pulse pattern buffer 417. The total number of matching scores would then be 231 (11×21). As described above, a maximum matching score can be selected from this set. The output of the T4 pattern correlator 430 would then be a single best score across all channels of the processed audio input data and across all templates. In some embodiments, the T4 pattern correlator 430 selects the second best score, the third best score, and the like, or selects a set of best matching scores whether consecutive or not.

In some embodiments, the matching scores computed by the T4 pattern correlator 430 are further processed by a T4 score filter 432 in order to minimize the detection of false alarms for common sounds that closely mimic the T4 audible alert signal. The T4 score filter 432 analyzes the temporal pattern of matching scores and rejects mimic signals. For example, the T4 score filter can verify that only one primary score peak occurs every T4 alert signal cycle by examining the time sequence of the matching scores across multiple channels of the processed audio data. In some embodiments, such as when the output of the T4 pattern correlator is a single best matching score across all channels of the processed audio input data, the T4 score filter 430 is not used.

A T4 threshold detector 433 determines whether the processed audio input data comprises the T4 audible alert signal. This determination can be made by comparing the matching scores computed by the T4 pattern correlator 430, and processed by the T4 score filter 432, to one or more threshold matching scores. In some embodiments, the highest matching score can be compared to a threshold. In some embodiments, the T4 threshold detector 433 can automatically readjust the threshold by using the SAI value 414, as is explained above. Increasing the threshold as the SAI value increases can facilitate the reduction of false alarm conditions at the expense of making the signal analyzer 305 less sensitive. Conversely, decreasing the threshold when the SAI value decreases can facilitate the detection of faint T4 audible alarm signals and make the signal analyzer 305 more sensitive.

In some embodiments, the occurrence of false alarm conditions can be further reduced by checking for the presence of consecutive detection events, such as detections of T4 audible alert signals for consecutively processed audio input signal segments. For example, the T4 threshold detector 433 can check for presence of at least six consecutive detection events. In some embodiments, the occurrence of false alarm conditions can be reduced by checking for the presence of a minimum number of detection events within a set of consecutively processed audio input signal segments. For example, the T4 threshold detector 433 can check for presence of six detection events in a set of nine consecutively processed audio input signal segments. Further, the variation of consecutive detection events or the variation of all detection events across the set can be examined to cause the reduction of false alarm conditions.

In some embodiments, the T4 threshold detector 433 generates a carbon monoxide alarm alert notification 434 when the matching score computed by the T4 pattern correlator 430 crosses a detection threshold or when the presence of consecutive detection events is detected. As is illustrated in FIG. 2, one or more alert devices configured to generate supplemental alert signals can then be notified or activated.

The audible alert detection systems and methods described herein are not limited to the detection of T3 and T4 alarm signals. The disclosed systems and methods can also be applied to the detection of other types of audible alert signals.

The disclosed system and methods can be applied to the detection of audible alert signals in the frequency range above 3.5 kHz or below 2.9 kHz. For example, the disclosed system and methods can be applied to the detection of audible alert signals whose "on" periods are in the form of an approximately 520 Hz square wave. For purposes of detecting such a signal, the analysis may be limited to frequencies falling close to 520 Hz (the fundamental frequency of the square wave), or may be extended to one or more of the higher-frequency harmonics. For example, a first plurality of frequency bands corresponding to the fundamental frequency may be analyzed to generate respective sets of matching scores, and a second plurality of frequency bands corresponding to the first (or higher) harmonic may also be analyzed to generate additional (respective) sets of matching scores. These various sets of matching scores can be used in combination to determine whether an audible alert is present.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Although this invention has been described in terms of certain preferred embodiments and applications, other embodiments and applications that are apparent to those of ordinary skill in the art, including embodiments which do not provide all of the features and advantages set forth herein, are also within the scope of this invention. Accordingly, the scope of the present invention is defined only by reference to the appended claims.

What is claimed is:

1. A method for detecting audible alert signals implemented in signal processing circuitry, the method comprising:

generating a digital representation of a received audio signal;

for each of a plurality of templates, comparing the digital representation of the received audio signal to the respective template, and generating a matching score representing a degree of match between the digital representation of the received audio signal and the respective template, wherein each template corresponds to an acceptable audible alert signal timing pattern, and the plurality of templates encompass an acceptable range of variation in a timing pattern of a standard audible alert signal; and determining, based at least partly on the matching scores corresponding to the plurality of templates, whether an audible alert signal is present.

2. The method of claim 1, wherein the plurality of templates comprises templates that correspond to variations in a Temporal-3 timing pattern.

3. The method of claim 1, wherein the plurality of templates comprises templates that correspond to variations in a Temporal-4 timing pattern.

4. The method of claim 1, wherein the plurality of templates includes at least ten templates.

5. The method of claim 1, wherein generating the digital representations comprises applying band pass filtering such that the digital representation corresponds to a frequency band falling within a range of acceptable frequencies of an audible alert signal.

6. The method of claim 5, further comprising repeating the generating and comparing steps for each of multiple additional frequency bands falling within the range, to thereby generate a separate set of matching scores for each of a plurality of frequency ranges, and wherein said determining step comprises analyzing each of the sets of matching scores.

7. The method of claim 6, wherein the number of the frequency bands is at least ten.

8. The method of claim 6, wherein the number of the frequency bands is at least twenty.

9. The method of claim 6, wherein each of the plurality of frequency ranges falls within the range of 2.9 kHz to 3.5 kHz.

10. The method of claim 1, further comprising:

estimating a noise content of the received audio signal; and determining, based at least partly on the noise content, whether an audible alert signal is present.

11. A computer-readable medium storage which stores executable instructions capable of causing a computing device to perform a signal processing method that comprises:

generating a digital representation of a received audio signal;

for each of a plurality of templates, comparing the digital representation of the received audio signal to the respective template, and generating a matching score representing a degree of match between the digital representation of the received audio signal and the respective template, wherein each template corresponds to an acceptable audible alert signal timing pattern, and the plurality of templates encompass an acceptable range of variation in a timing pattern of a standard audible alert signal; and determining, based at least partly on the matching scores corresponding to the plurality of templates, whether an audible alert signal is present.

12. The computer-readable medium of claim 11, wherein the plurality of templates comprises templates that correspond to variations in a Temporal-3 timing pattern.

13. The computer-readable medium of claim 11, wherein the plurality of templates comprises templates that correspond to variations in a Temporal-4 timing pattern.

14. The method of claim 11, wherein the plurality of templates includes at least ten templates.

15. A signal processing system for detecting audible alert signals comprising:

a circuit configured to receive an audio signal and to generate a digital representation of the received audio signal;

a memory buffer configured to store a plurality of templates, wherein each template corresponds to an acceptable audible alert signal timing pattern, and the plurality of templates encompass an acceptable range of variation in a timing pattern of a standard audible alert signal; and a circuit configured to:

compare, for each template, the digital representation of the received audio signal to the respective template;

generate, for each template, a matching score representing a degree of match between the digital representation of the received audio signal and the respective template; and determine, based at least partly on the matching scores corresponding to the plurality of templates, whether an audible alert signal is present.

16. The signal processing system of claim 15, wherein the plurality of templates comprises templates that correspond to variations in a Temporal-3 timing pattern.

17. The signal processing system of claim 15, wherein the plurality of templates comprises templates that correspond to variations in a Temporal-4 timing pattern.

18. The method of claim 15, wherein the number of the frequency bands is twenty-one.

19. The signal processing system of claim 15, further comprising a supplemental alert generator configured to generate a supplemental alert signal in response to the determination that an audible alert signal is present.

20. The signal processing system of claim 19, wherein the supplemental alert signal is a low-frequency square wave sound pattern.

* * * * *

UNITED STATES PATENT AND TRADEMARK OFFICE

CERTIFICATE OF CORRECTION

PATENT NO. : 8,269,625 B2
APPLICATION NO. : 12/756698
DATED : September 18, 2012
INVENTOR(S) : Hoy et al.

It is certified that error appears in the above-identified patent and that said Letters Patent is hereby corrected as shown below:

At page 1, item 75 (Inventors), line 1, change "Leslies" to --Leslie--.

At column 9, line 15, change "SAT" to --SAI--.

Signed and Sealed this
Fifth Day of March, 2013

Teresa Stanek Rea
*Acting Director of the United States Patent and Trademark Office*